US008863527B2

(12) United States Patent
Holcomb et al.

(10) Patent No.: US 8,863,527 B2
(45) Date of Patent: Oct. 21, 2014

(54) COMBUSTOR LINER

(75) Inventors: Marcus Timothy Holcomb, Carmel, IN (US); Todd Taylor, Whiteland, IN (US); Randall E. Yount, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 920 days.

(21) Appl. No.: 12/433,104

(22) Filed: Apr. 30, 2009

(65) Prior Publication Data

US 2010/0275606 A1 Nov. 4, 2010

(51) Int. Cl.

| | |
|---|---|
| ***F23R 3/42*** | (2006.01) |
| ***F23R 3/28*** | (2006.01) |
| ***F23R 3/00*** | (2006.01) |

(52) U.S. Cl.

CPC . *F23R 3/002* (2013.01); *F23R 3/42* (2013.01); *F23R 3/283* (2013.01)

USPC ..... 60/752; 60/796; 60/798; 60/799; 60/800

(58) Field of Classification Search

USPC ..... 60/796, 798, 799, 800, 752–760

See application file for complete search history.

(56) References Cited

U.S. PATENT DOCUMENTS

| | | | | |
|---|---|---|---|---|
| 4,365,470 | A * | 12/1982 | Matthews et al. | 60/800 |
| 4,413,477 | A | 11/1983 | Dean et al. | |
| 4,912,922 | A | 4/1990 | Maclin | |
| 5,291,732 | A | 3/1994 | Halila | |
| 5,323,601 | A | 6/1994 | Jarrell et al. | |
| 5,335,502 | A * | 8/1994 | Roberts et al. | 60/752 |
| 5,701,733 | A | 12/1997 | Lewis et al. | |
| 5,758,503 | A | 6/1998 | DuBell et al. | |
| 5,894,732 | A * | 4/1999 | Kwan | 60/756 |
| 5,956,955 | A * | 9/1999 | Schmid | 60/748 |
| 5,987,879 | A | 11/1999 | Ono | |
| 6,347,508 | B1 | 2/2002 | Smallwood et al. | |
| 6,449,952 | B1 | 9/2002 | Emilianowicz et al. | |
| 6,453,675 | B1 | 9/2002 | Royle | |
| 6,647,729 | B2 | 11/2003 | Calvez et al. | |
| 6,775,985 | B2 | 8/2004 | Hansel et al. | |
| 6,895,761 | B2 | 5/2005 | Mitchell et al. | |
| 6,904,757 | B2 | 6/2005 | Mitchell et al. | |
| 6,931,855 | B2 | 8/2005 | Glessner et al. | |
| 7,007,480 | B2 | 3/2006 | Nguyen et al. | |
| 7,024,863 | B2 | 4/2006 | Morenko | |
| 7,093,440 | B2 | 8/2006 | Howell et al. | |
| 7,134,286 | B2 | 11/2006 | Markarian et al. | |
| 7,140,189 | B2 | 11/2006 | Markarian et al. | |
| 7,152,411 | B2 | 12/2006 | McCaffrey et al. | |
| 7,237,389 | B2 | 7/2007 | Ryan et al. | |
| 7,269,957 | B2 | 9/2007 | Martling et al. | |
| 7,310,952 | B2 | 12/2007 | Howell et al. | |
| 7,322,196 | B2 | 1/2008 | Tiemann | |
| 7,338,244 | B2 | 3/2008 | Glessner et al. | |
| 7,360,364 | B2 | 4/2008 | Danis et al. | |
| 7,395,669 | B2 | 7/2008 | Sherwood | |
| 7,412,834 | B2 | 8/2008 | Bes et al. | |
| 7,415,826 | B2 | 8/2008 | McMasters et al. | |
| 7,421,842 | B2 | 9/2008 | Parker et al. | |
| 2008/0092546 | A1 * | 4/2008 | Stastny et al. | 60/752 |

* cited by examiner

*Primary Examiner* — Phutthiwat Wongwian
*Assistant Examiner* — Steven Sutherland
(74) *Attorney, Agent, or Firm* — Krieg DeVault LLP

(57) ABSTRACT

A combustor liner for a turbine engine is disclosed herein. The combustor liner includes an inner liner surface operable to define at least part of a combustion chamber in a turbine engine. The inner liner surface extends along a portion of a chordal arc on a first side of the chordal arc. The combustor liner also includes a bearing surface operable to support a floating dome panel. At least part of the bearing surface is spaced from the chordal arc on a second side of the chordal arc opposite the first side.

15 Claims, 4 Drawing Sheets

COMBUSTOR LINER

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of FA8650-07-C-2803 awarded by the Department of Defense.

BACKGROUND OF THE INVENTION

1. Field of the Invention

The invention relates to a combustor liner for a turbine engine.

2. Description of Related Prior Art

A dome panel can be positioned at a forward end of combustor section in a turbine engine. Generally, the dome panel can support or define one or more "swirlers" that mix compressed air exiting the compressor section and fuel. The air/fuel mixture enters the combustor section and is ignited in a combustion chamber. In some configurations of turbine engines, the dome panel can be fixed and the combustor liner can move. In other configurations of turbine engines, the dome panel can shift or "float" and the combustor liner can be fixed. The floating dome panel can be supported during movement by a bearing surface associated with the fixed combustor liner.

SUMMARY OF THE INVENTION

In summary, the invention is a combustor liner for a turbine engine. The combustor liner includes an inner liner surface operable to define at least part of a combustion chamber in a turbine engine. The inner liner surface extends along a portion of a chordal arc on a first side of the chordal arc. The combustor liner also includes a bearing surface operable to support a floating dome panel. At least part of the bearing surface is spaced from the chordal arc on a second side of the chordal arc opposite the first side.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

Figure 1:
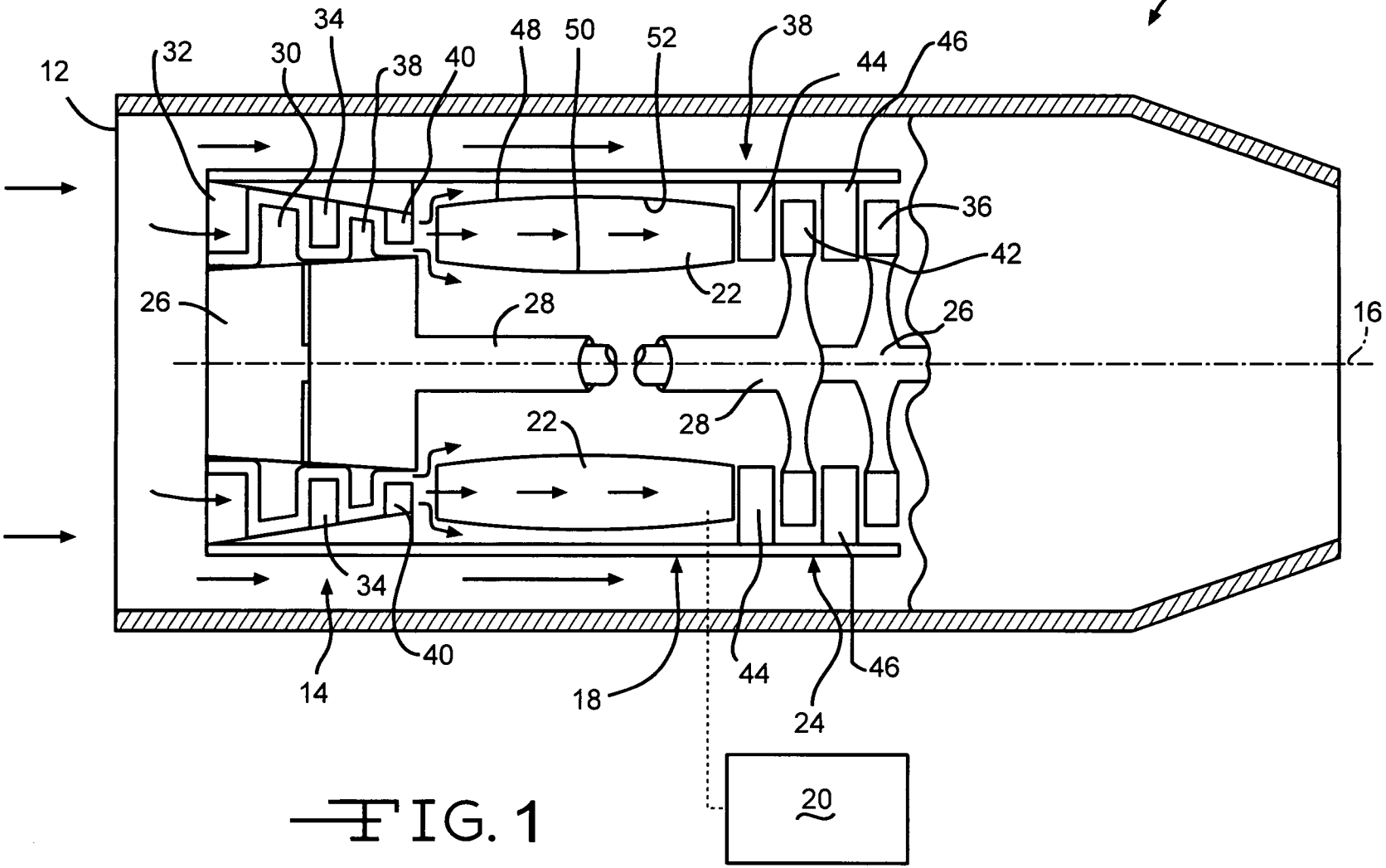
FIG. 1 is a schematic of a turbine engine which incorporates an exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix.

Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention provides a combustor liner for a turbine engine in which a floating dome panel can be supported by bearing surface associated with a fixed combustor liner, wherein the bearing surface is positioned inward of the inner liner surface (generally toward the combustion chamber). In the exemplary embodiments of the invention, shift the bearing surface inward has allowed the height of the combustor liner to be reduced. Furthermore, the reduction in height has allowed the length of the overall turbine engine to be reduced. These benefits provided by the exemplary embodiments of the invention will be described in greater detail below.

FIG. 1 schematically shows a turbine engine 10. The various unnumbered arrows represent the flow of fluid through the turbine engine 10. All of the flows through the engine are not necessarily identified. The turbine engine 10 can produce power for several different kinds of applications, including vehicle propulsion and power generation, among others. The exemplary embodiments of the invention disclosed herein, as well as other embodiments of the broader invention, can be practiced in any configuration of turbine engine.

The exemplary turbine engine 10 can include an inlet 12 to receive fluid such as air. The turbine engine 10 may include a fan to direct fluid into the inlet 12 in alternative embodiments of the invention. The turbine engine 10 can also include a compressor section 14 to receive the fluid from the inlet 12 and compress the fluid. The compressor section 14 can be spaced from the inlet 12 along a centerline axis 16 of the turbine engine 10. The turbine engine 10 can also include a combustor section 18 to receive the compressed fluid from the compressor section 14. The compressed fluid can be mixed with fuel from a fuel system 20 and ignited in an annular combustion chamber 22 defined by the combustor section 18. The combustor section 18 can include an outer liner 48 and an inner liner 50. Each of the liners 48, 50 can be annular, encircling the centerline axis 16. The turbine engine 10 can also include a turbine section 24 to receive the combustion gases from the combustor section 18. The energy associated with the combustion gases can be converted into kinetic energy (motion) in the turbine section 24.

In FIG. 1, shafts 26, 28 are shown disposed for rotation about the centerline axis 16 of the turbine engine 10. Alternative embodiments of the invention can include any number of shafts. The shafts 26, 28 can be journaled together for relative rotation. The shaft 26 can be a low pressure shaft supporting compressor blades 30 of a low pressure portion of the compressor section 14. A first row or plurality of compressor vanes 32 can be positioned to direct fluid flow to the blades 30 and a second row or plurality of compressor vanes 34 can be positioned to direct fluid flow downstream of the blades 30. The shaft 26 can also support low pressure turbine blades 36 of a low pressure portion of the turbine section 24.

The shaft 28 can encircle the shaft 26. As set forth above, the shafts 26, 28 can be journaled together, wherein bearings are disposed between the shafts 26, 28 to permit relative rotation. The shaft 28 can be a high pressure shaft supporting compressor blades 38 of a high pressure portion of the compressor section 14. A plurality of vanes 40 can be positioned to receive fluid from the blades 34 and direct the fluid into the combustor section 18. The shaft 28 can also support high pressure turbine blades 42 of a high pressure portion of the turbine section 24. A first row or plurality of turbine vanes 44 can be positioned to direct combustion gases over the blades 36. A second row of vanes 46 can be positioned downstream of the blades 42 to direct fluid to the blades 36.

Figure 2:
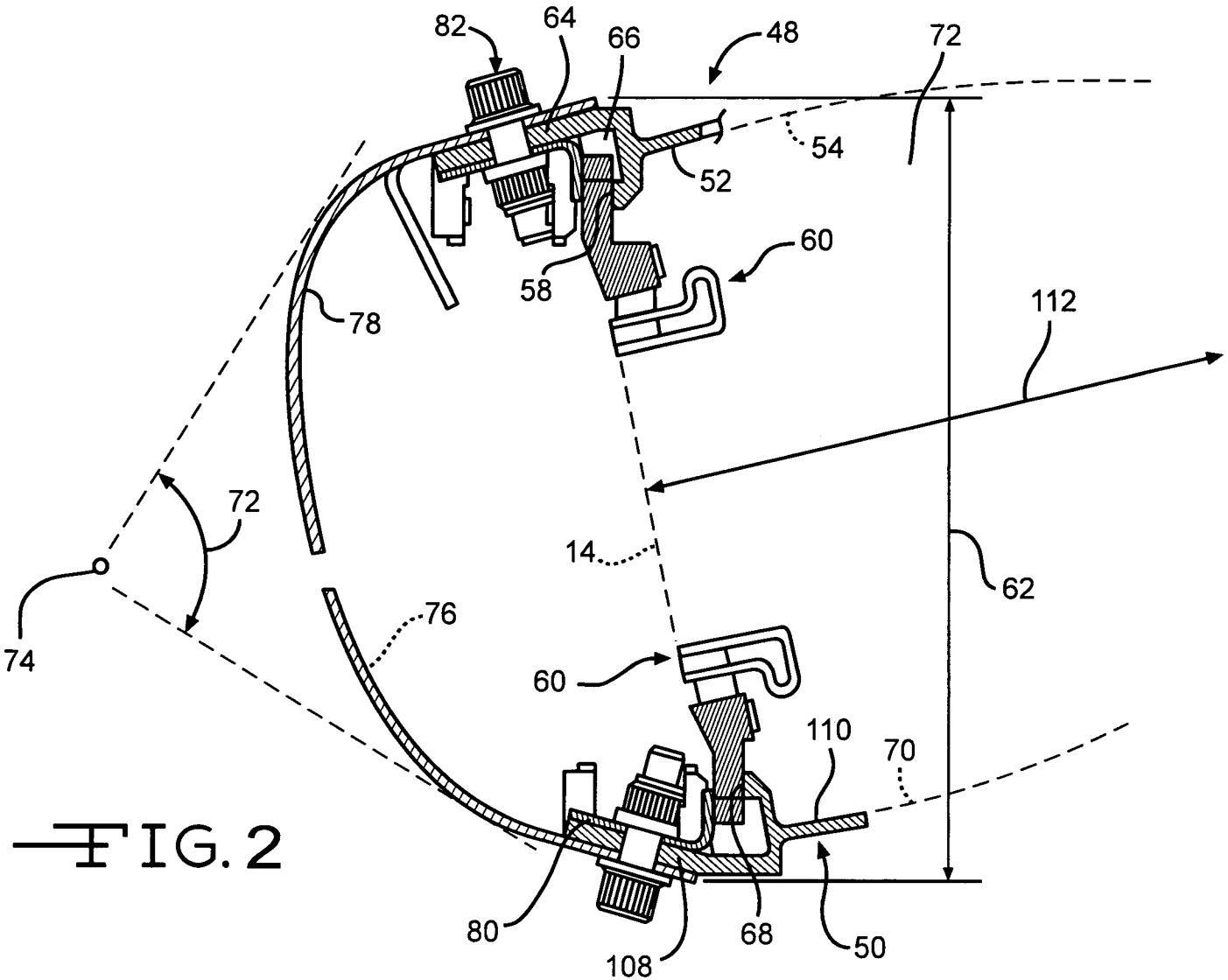
FIG. 2 is a cross-section of a portion of the turbine engine showing the first exemplary embodiment of the invention.
Figure 3:
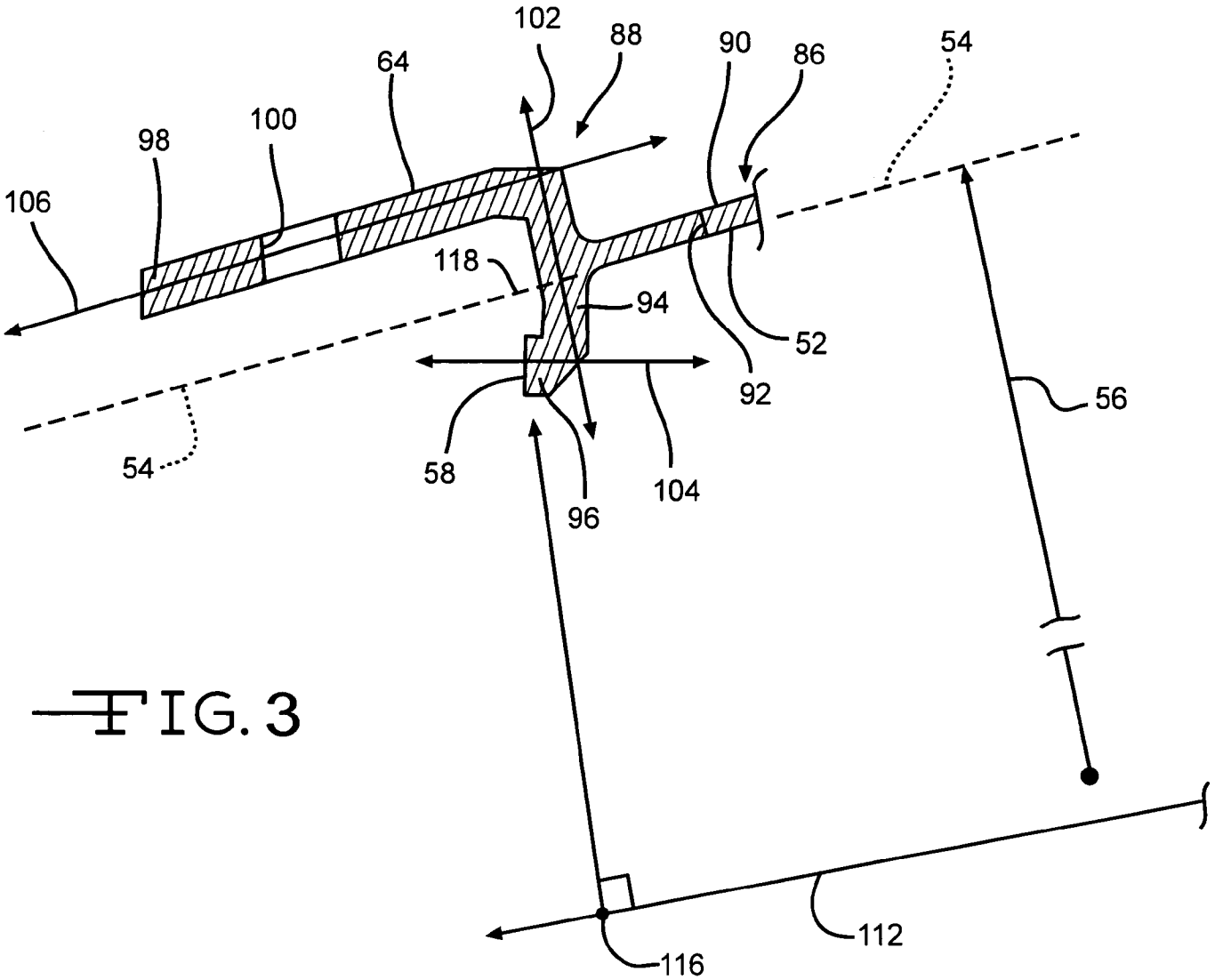
FIG. 3 is a magnified view of a portion of a FIG. 2.

FIG. 2 is a cross-section of a portion of a turbine engine showing the first exemplary embodiment of the invention non-schematically. In FIG. 2, the combustor liner 48 is shown including an inner liner surface 52 operable to define at least part of the combustion chamber 22. The exemplary inner liner surface 52 is concave in facing the combustion chamber 22, but could be convex in alternative embodiments of the invention. The inner liner surface 52 extends along a portion of a chordal arc 54. The chordal arc 54 can be defined in a plane including the centerline axis 16 (shown in FIG. 1), a longitudinal cross-section plane. The chordal arc 54 can be defined by a single radius or can be comprised of multiple arc portions defined by different radii blended together. In the exemplary embodiment of the invention, the chordal arc 54 can be defined by a single radius, referenced by the arrow 56 in FIG. 3. In FIG. 3, the chordal arc 54 is shown extending past the inner liner surface 52, thus the exemplary inner liner surface 52 extends along a portion of the exemplary chordal arc 54.

FIGS. 2 and 3 show the inner liner surface 52 positioned on a first side of the chordal arc 54, the side "above" the chordal arc 54 based on the perspective of the Figures. The exemplary combustor liner 48 can also include a bearing surface 58 operable to support a floating dome panel, referenced at 60 in FIG. 2. As shown best in FIG. 3, at least part of the bearing surface 58 is spaced from the chordal arc 54 on a second side of the chordal arc 54 opposite the first side. The second side can be the side "below" the chordal arc 54 based on the perspective of the Figures. The exemplary bearing surface 58 can be fully spaced from the chordal arc 54 on the second side.

Shifting the bearing surface 58 from the chordal arc 54 allows the height of the combustor section 18, referenced by arrow 62 in FIG. 2, to be reduced. First, in supporting a dome panel 60, the bearing surface 58 can be spaced inward of a mounting portion 64 of the combustor liner 48 in order to define a space 66 for accommodating the shifting movement of the dome panel 60. The height referenced by arrow 62 relates to the distance between the outer mounting portion 64 and an inner mounting portion 108. The mounting portion 64 can be moved closer to the chordal arc 54 (and the height therefore reduced) and the space 66 still retained when the bearing surface 58 is shifted away from the chordal arc 54 toward the second side. When the mounting portion 64 is moved closer to the chordal arc 54, the height referenced by arrow 62 can be reduced. Furthermore, the inner combustor liner 50 can also define a bearing surface 68 shifted toward a second side of a chordal arc 70. Shifting both bearing surfaces 58, 68 allows the height referenced by arrow 62 to be further reduced. Reducing the height referenced by arrow 62 can result in a weight reduction for the combustor section 18.

Reducing the height referenced by arrow 62 can also result in a length reduction in the turbine engine. Generally, working fluid such as air will be directed toward the dome panel at a diffuser dump angle, represented by arrow 72 and having an origin referenced at point 74. The point 74 can represent, generally, the point at which the compressed working fluid exits the compressor section 14 (shown in FIG. 1) and begins to diffuse while moving into the combustor section 18 (shown in FIG. 1). It can be desirable to design this area of the turbine engine based on a minimum diffuser dump angle to enhance the aerodynamic properties of the flow of the working fluid. The point 74 can be positioned a distance from the inner and outer cowls 76, 78; the distance defined when the edges of the diffuser dump angle represented by arrow 72 extend generally tangent to the inner and outer cowls 76, 78 as shown in FIG. 2. With reference to the view of FIG. 2, if the height represent by arrow 62 were increased, the point 74 would be shifted to the left in order for the edges of the diffuser dump angle represented by arrow 72 to be generally tangent to the inner and outer cowls 76, 78. Further, if the point 74 was shifted to the left, the overall length of the turbine engine would increase. Thus, the reducing the height referenced by arrow 62 can also result in a length reduction in the turbine engine.

FIG. 2 also shows other structures of the first exemplary embodiment of the invention. The dome panel 60 can be biased in the aft direction by a resilient bracket 80. The bracket 80 can be continuous and annular or can be defined by a plurality of discrete spring members positioned at each bolt 82. The cowls 76, 78, the mounting portion 64, and the bracket 80 can be connected together through an aperture 100 (shown in FIG. 3) in mounting portion 64.

FIG. 2 shows the outer combustor liner 48 having the inner liner surface 52 extending along a portion of the first chordal arc 54. The first bearing surface 58 is shown supporting the radially outer edge of the dome panel 60. FIG. 2 also shows the inner combustor liner 50 having a second inner liner surface 110 extending along a portion of a second chordal arc 70. The second bearing surface 68 is shown supporting a radially inner edge of the dome panel 60. A combustor axis 112 is shown extending equidistantly between the first and second chordal arcs 54, 70. The exemplary combustor axis 112 can begin generally proximate to an entry plane 114 of the dome panel 60 and extend in an aft direction. The exemplary combustor axis 112 can be straight or can be partially or fully arcuate. The first and second bearing surfaces 58, 68 can be positioned along the combustor axis 112 and be radially-spaced from the combustor axis 112. The first and second bearing surfaces 58, 68 can be positioned closer to the combustor axis 112 than the first and second chordal arcs 54, 70 at the respective positions of the first and second bearing surfaces 58, 68 along the combustor axis 112. FIG. 3 shows this relative to the bearing surface 58. In FIG. 3, the bearing surface 58 can be radially-spaced from a point 116 positioned along the combustor axis 112. The bearing surface 58 can be positioned closer to the combustor axis 112 than the first chordal arc 54 relative to the point 116. For example, a point 118 can be positioned along the chordal arc and be radially-spaced from the point 116 positioned along the combustor axis 112. The exemplary bearing surface 58 is positioned closer to the combustor axis 112 than the point 118 of the chordal arc 54. The bearing surface 68 is similarly closer to the combustor axis 112 than the chordal arc 70.

FIG. 3 is a magnified view of a portion of the combustor liner shown in FIG. 2. As shown in FIG. 3, the combustor liner 48 can include a liner portion 86 and a hanger portion 88. The liner portion 86 can define the inner liner surface 52 and have an outer surface 90 opposite the inner liner surface 52. The hanger portion 88 can be fixed relative to the liner portion 86 and include the mounting portion 64 and a first arm 94 extending to a first distal end 96 defining the bearing surface 58. The mounting portion 64 can be viewed as a second arm 64. The second arm 64 can extend to a second distal end 98 spaced from the first distal end 96 and include an aperture 100 for receiving a fastener, such as the bolt 82 shown in FIG. 2. It is noted that one or both of the first second "arms" 94, 64 can be annular ring-like structures (appearing as arms in cross-section) or can be defined by a plurality of discrete arm members positioned about the centerline axis at circumferentially-spaced positions. The liner and hanger portions 86, 88 can be separately formed and fixed together at a weld joint 92. In alternative embodiments of the invention, the liner and hanger portions 86, 88 can be integrally formed with one another.

Figure 4:
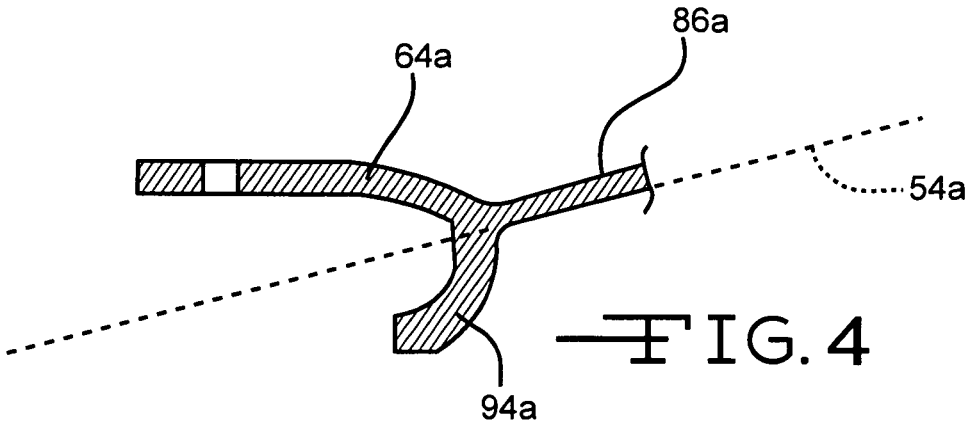
FIG. 4 is a view analogous to the view in FIG. 3, but of a second embodiment of the invention.

FIGS. 3-6 show various cross-sections of alternative embodiments of the invention. FIG. 4 shows a second embodiment of the invention in which first and second arms 94*a*, 64*a* extend away from a liner portion 86*a* and define a wishbone shape rather than initially extending away from a chordal arc 54*a* in opposite directions, such as occurs in the first exemplary embodiment of the invention shown in FIG. 3. The wishbone shape may be desirable if stress concentrations arise in applications of the first exemplary embodiment or other embodiments.

Referring again to FIG. 3, in the first embodiment, the first and second arms 94, 64 can extend respective first and second distances in opposite directions from the chordal arc 54 and then extend in intersecting directions after the first and second distances. The first and second arms 94, 64 can initially extend respective first and second distances in opposite directions from the chordal arc 54 along an axis 102. After the first distance, the first arm 94 can extend along an axis 104. After the second distance, the second arm 64 can extend along an axis 106. The axes 104, 106 can intersect one another. This arrangement can be a space-saving feature.

Figure 5:
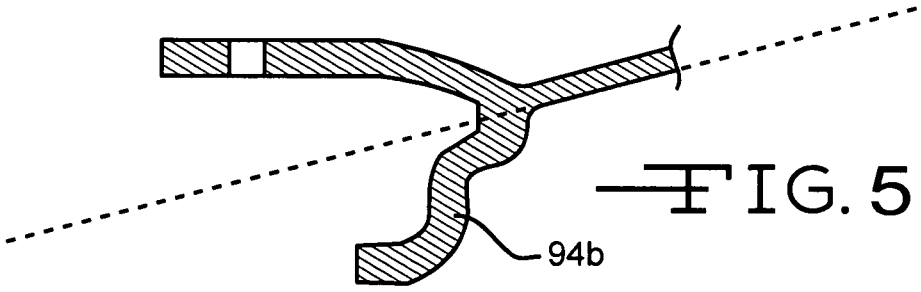
FIG. 5 is a view analogous to the views in FIGS. 3 and 4, but of a third embodiment of the invention.

FIG. 5 shows a third embodiment of the invention in which the first arm 94*b* defines a generally s-shaped cross-section. The "s" shape can be desirable to create a spring-like effect in the first arm 94*b*. In alternative embodiments of the invention, one or both of the arms can be s-shaped in cross-section or have other shapes that create a spring-like effect.

Figure 6:
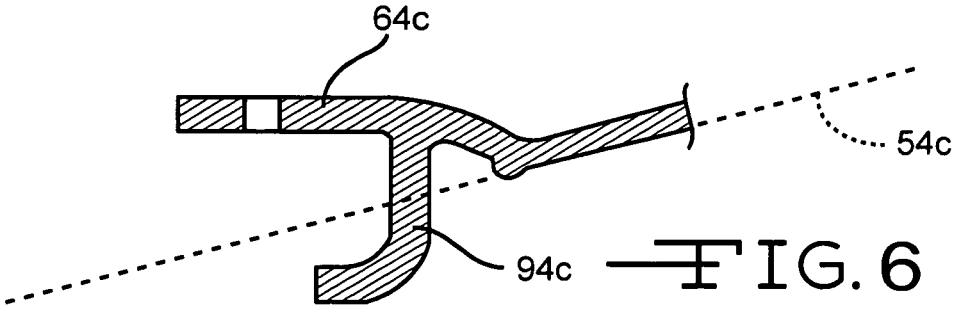
FIG. 6 is a view analogous to the views in FIGS. 3-5, but of a fourth embodiment of the invention.

FIG. 6 shows a fourth embodiment of the invention in which the first arm 94*c* extends from the second arm 64*c*. Also, the first arm is partially positioned on both the first and second sides of the chordal arc 54*c*. In the other shown embodiments, the first arm is fully positioned on the second side of the chordal arc. The arrangement of the fourth embodiment can be desirable to maximize the distance between the first arm 94*c* and the combustion chamber.

In the embodiments of the invention, both of the first and second arms extend generally transverse to the chordal arc. However, this is not a requirement of the invention. For example, the second arm could extend along the chordal arc in a manner similar to the liner portion. Further, the second arm 64 could be aligned with the liner portion in alternative embodiments of the invention and not be positioned radially outward of the outer surface relative to the chordal arc, as shown in the embodiments. Also, the bearing surface is transverse to the chordal arc in the exemplary embodiments. This aspect of the exemplary embodiments is also not a requirement of the invention. The orientation of the bearing surface can be selected as desired for a particular operation environment.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A combustor liner for a turbine engine comprising:

an inner liner surface operable to define at least part of a combustion chamber in a turbine engine, wherein the inner liner surface has a shape defined by a chordal arc and extends along the chordal arc, and wherein a wall of the combustion liner is disposed on a first side of said chordal arc;

a bearing surface operable to support a floating dome panel, wherein at least part of said bearing surface is spaced from said chordal arc on a second side of said chordal arc opposite said first side;

a liner portion defining said inner liner surface and having an outer surface opposite said inner liner surface;

a hanger portion fixed relative to said liner portion and including a first arm extending to a first distal end defining said bearing surface;

wherein said hanger portion further comprises a second arm extending to a second distal end spaced from said first distal end; and wherein said first and second arms initially extend away from said chordal arc in opposite directions.

2. The combustor liner of claim 1 wherein all of said bearing surface is spaced from said chordal arc on said second side.

3. The combustor liner of claim 1 wherein said bearing surface is transverse to said chordal arc.

4. The combustor liner of claim 1 wherein said inner liner surface is one of convex and concave in facing the combustion chamber.

5. The combustor liner of claim 1 wherein said first arm is fully positioned on said second side of said chordal arc.

6. The combustor liner of claim 1 wherein said liner and hanger portions are further defined as being separately formed and fixed together.

7. The combustor liner of claim 1 wherein said second arm is positioned radially outward of said outer surface relative to said chordal arc.

8. The combustor liner of claim 7 wherein said first arm is partially positioned on said second side and partially positioned on said first side of said chordal arc.

9. The combustor liner of claim 1 wherein said first and second arms extend respective first and second distances in opposite directions from said chordal arc and then extend in intersecting directions after said respective first and second distances.

10. The combustor liner of claim 1 wherein both of said first and second arms extend transverse to said chordal arc.

11. The combustor liner of claim 1 wherein at least one of said first and second arms defines an s-shaped cross-section.

12. The combustor liner of claim 1 wherein one of said first and second arms extends from the other of said first and second arms.

13. A turbine engine comprising:

a floating dome panel encircling a centerline axis of the turbine engine; and at least one combustor liner including:

an inner liner surface operable to define at least part of a combustion chamber, wherein the inner liner surface has a shape defined by a chordal arc and extends along the chordal arc, and wherein a wall of the combustion liner is disposed on a first side of said chordal arc;

a bearing surface operable to support said floating dome panel, wherein at least part of said bearing surface is spaced from said chordal arc on a second side of said chordal arc opposite said first side, wherein said floating dome panel is slidable along said bearing surface in a direction having a radial directional component relative to the centerline axis; and a hanger portion having a first arm extending to a first distal end defining said bearing surface and a second arm extending to a second distal end spaced from said first distal end, wherein the first and second arms initially extend away from said chordal arc in opposite directions.

14. The turbine engine of claim 13 wherein said at least one combustor liner further comprises:

an outer combustor liner having a first inner liner surface and a first bearing surface supporting a radially outer edge of said floating dome panel, wherein the first inner liner surface has a first shape defined by a first chordal arc and extends along the first chordal arc; and an inner combustor liner having a second inner liner surface and a second bearing surface supporting a radially inner edge of said floating dome panel, wherein the second inner liner surface has a second shape defined by a second chordal arc and extends along the second chordal arc, wherein a combustor axis extends equidistantly between said first and second chordal arcs and wherein said first and second bearing surfaces are positioned closer to said combustor axis than said first and second chordal arcs at the respective positions of said first and second bearing surfaces along said combustor axis.

15. The turbine engine of claim 14 wherein each of said inner and outer combustor liners further comprises:

a first arm extending to a first distal end defining said bearing surface;

a second arm extending to a second distal end spaced from said first distal end and including an aperture for receiving a fastener.

* * * * *